United States Patent [19]

Bachman et al.

[11] Patent Number: 4,778,153

[45] Date of Patent: Oct. 18, 1988

[54] PROMOTIONAL ARTICLE WITH PRESSURE-SENSITIVE ADHESIVE PORTIONS AND METHOD OF MANUFACTURE

[75] Inventors: Gilbert Bachman, Atlanta; Billy Edenfield, Gainesville; Byrne E. Heninger, Marietta, all of Ga.

[73] Assignee: Dittler Brothers, Inc., Atlanta, Ga.

[21] Appl. No.: 761,861

[22] Filed: Aug. 2, 1985

[51] Int. Cl.[4] ..... B42D 15/00

[52] U.S. Cl. ..... 283/101; 283/106; 283/903

[58] Field of Search ..... 281/2, 5; 283/56, 61, 283/62, 101, 102, 105, 106, 903; 428/43, 121, 916

[56] References Cited

U.S. PATENT DOCUMENTS

| | | | |
|---|---|---|---|
| 2,023,829 | 12/1935 | Wright | 283/103 |
| 2,274,488 | 4/1941 | Kutscher | 283/106 |
| 2,321,184 | 5/1942 | Butterworth | 283/81 |
| 3,055,117 | 1/1960 | Bernstein et al. | 283/901 |
| 3,226,862 | 1/1966 | Gabruk | 283/101 X |
| 3,421,239 | 1/1969 | Smith | 283/101 X |
| 3,508,754 | 4/1970 | Shorin | 273/139 |
| 3,512,780 | 5/1970 | Allison | 283/106 X |
| 3,582,111 | 6/1971 | Siiter | 283/56 |
| 3,711,683 | 1/1973 | Hamisch, Sr. | 283/56 |
| 3,822,901 | 7/1974 | Seidman | 283/901 |
| 4,004,058 | 1/1977 | Buros et al. | 428/215 |
| 4,025,673 | 5/1977 | Reinnagel | 283/902 |
| 4,033,611 | 7/1977 | Johnsen | 283/101 |
| 4,059,912 | 11/1977 | Noah | 283/81 X |
| 4,074,911 | 2/1978 | Stipek, Jr. | 283/105 X |
| 4,095,824 | 6/1978 | Bachman | 283/903 |
| 4,174,857 | 11/1979 | Koza | 283/105 X |
| 4,241,942 | 12/1980 | Bachman | 283/903 |
| 4,277,089 | 7/1981 | Lockhart | 283/81 X |
| 4,299,637 | 11/1981 | Oberdeck et al. | 156/64 |
| 4,307,900 | 12/1981 | Krautsack | 283/56 |
| 4,368,903 | 1/1983 | Jones | 288/79 X |
| 4,428,526 | 1/1984 | Riley | 283/106 X |
| 4,479,838 | 10/1984 | Dunsirn et al. | 283/79 X |
| 4,551,373 | 11/1985 | Conlon | 283/106 X |

FOREIGN PATENT DOCUMENTS

| | | | |
|---|---|---|---|
| 1382922 | 2/1975 | United Kingdom . | |
| 1540639 | 2/1979 | United Kingdom | 283/106 |
| 2119345 | 11/1983 | United Kingdom | 281/2 |

OTHER PUBLICATIONS

Kellogg Company Bumper Sticker, 1984.

*Primary Examiner*—Paul A. Bell
*Attorney, Agent, or Firm*—Jones & Askew

[57] ABSTRACT

A promotional article made from a single sheet provides hidden indicia beneath tear-away panels. One panel of the sheet bears a pressure-sensitive adhesive and another bears a release coat. The sheet is folded to engage the adhesive with the release coat. One of these panels is perforated to provide removable portions, and the other is printed with indicia under either the adhesive or the release coat. Removable opaque mask areas can be applied to selected areas of the article to provide "scratch-off" game features. The promotional article can be in the form of a puzzle with a plurality of such removable portions which can be adhered to a puzzle assembly area of the article. The invention also provides a method of continuously manufacturing such articles from a web of sheet material.

21 Claims, 6 Drawing Sheets

Fig. 1
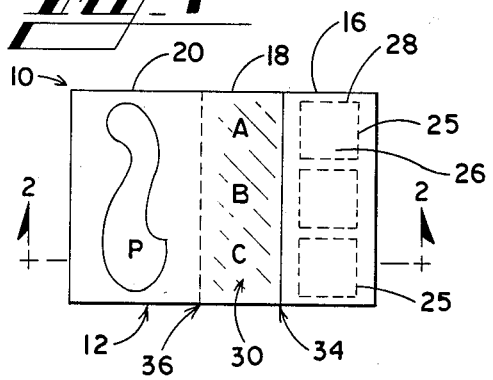
Fig. 3
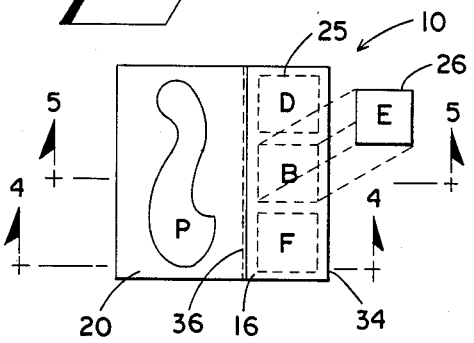
Fig. 2
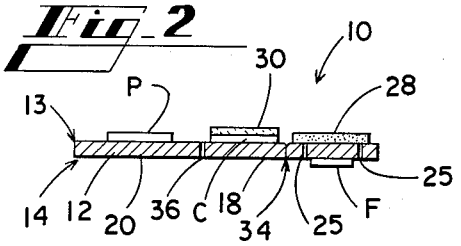
Fig. 4
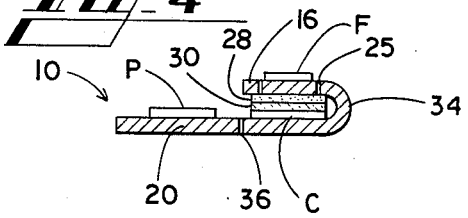
Fig. 5
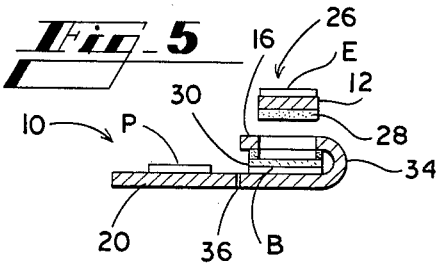
Fig. 7
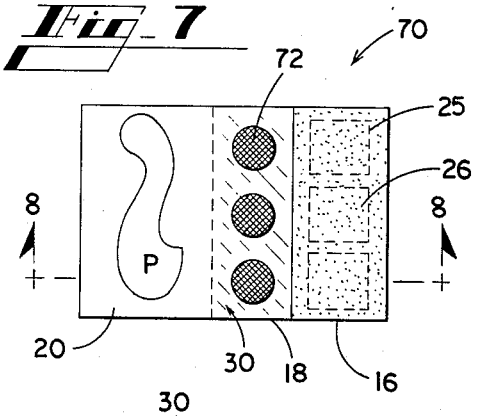
Fig. 9
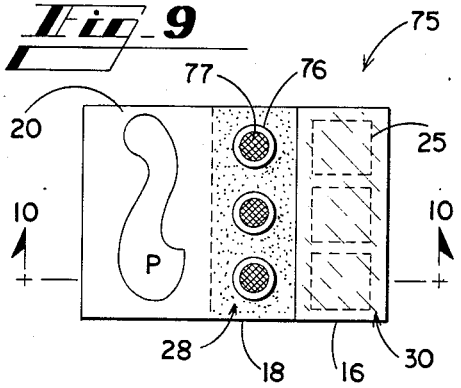
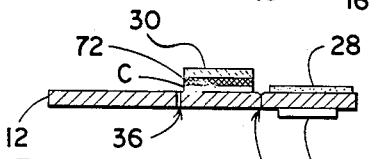
Fig. 8
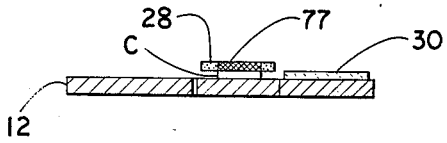
Fig. 10

Fig. 11
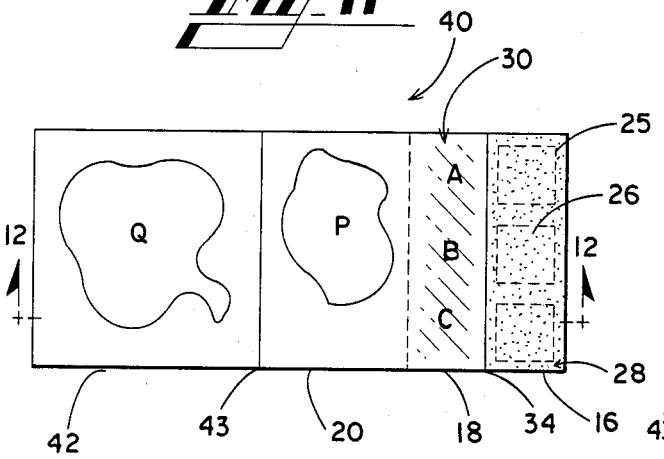
Fig. 13
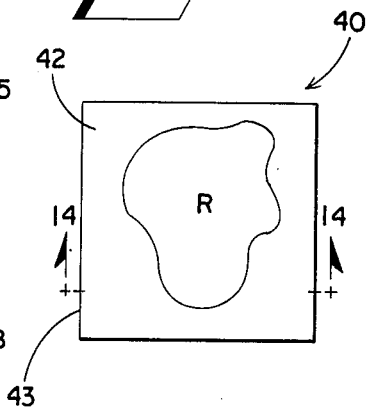
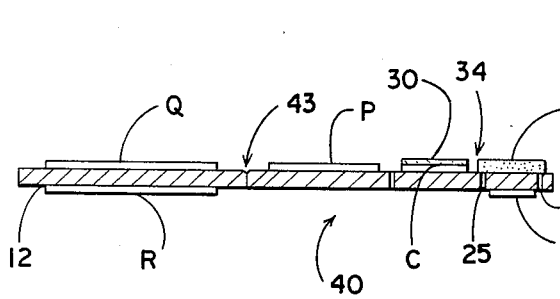
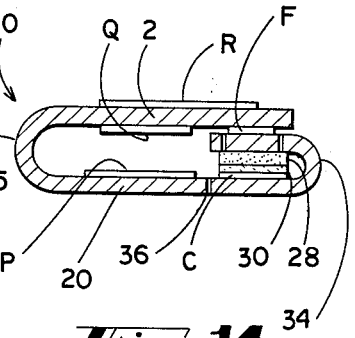
Fig. 12
Fig. 14
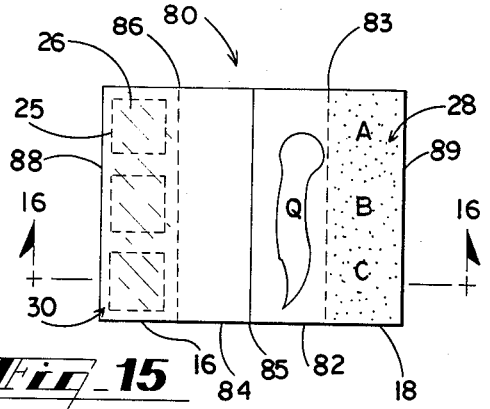
Fig. 15
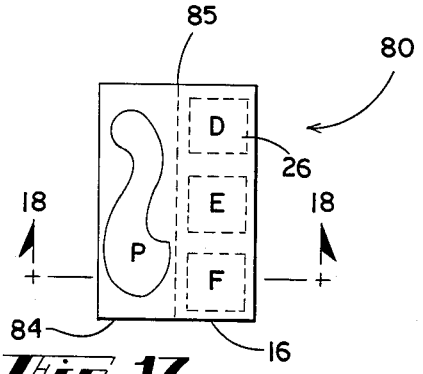
Fig. 17
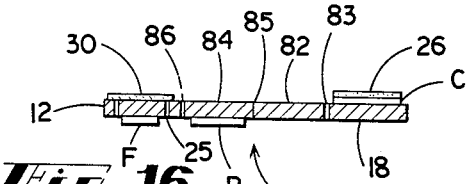
Fig. 16
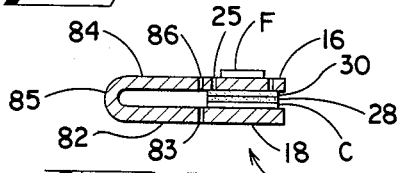
Fig. 18

Fig. 19
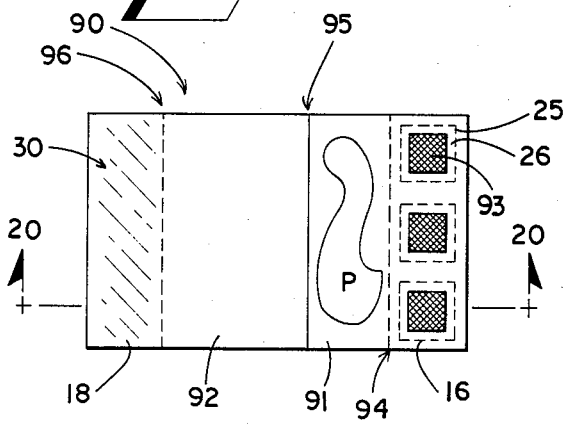
Fig. 21
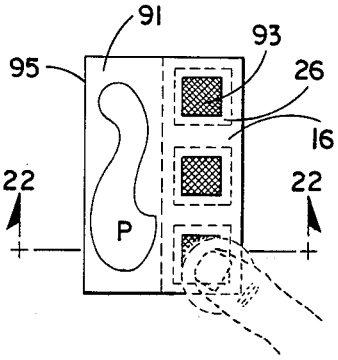
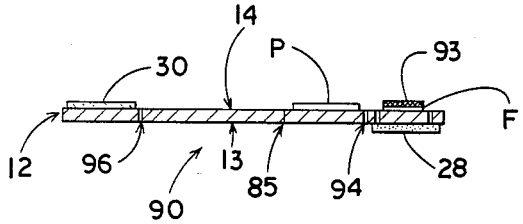
Fig. 20
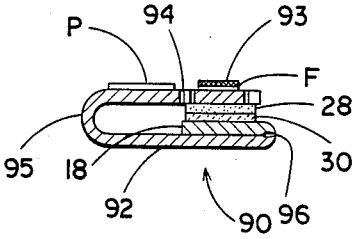
Fig. 22
Fig. 23
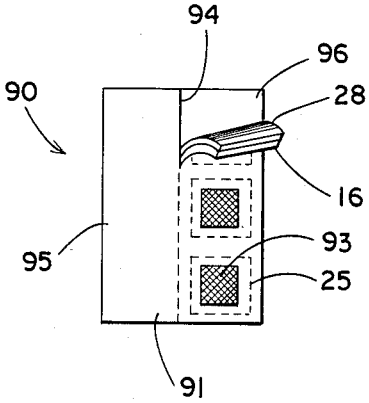

Fig_24
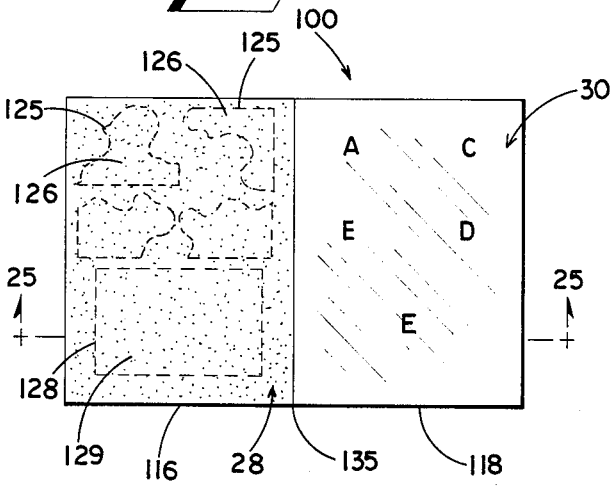
Fig_26
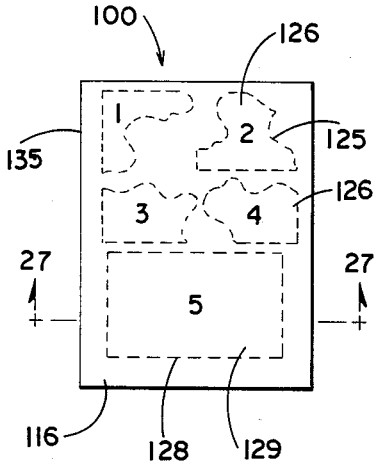
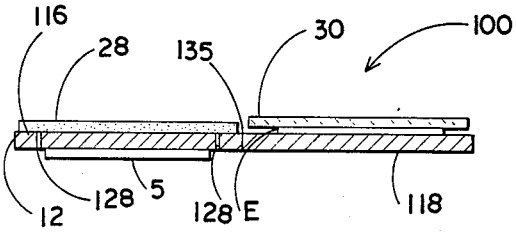
Fig_25
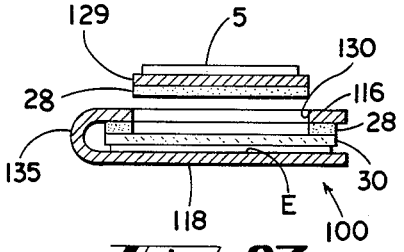
Fig_27
Fig_28
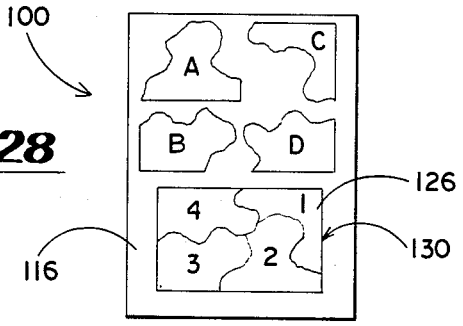

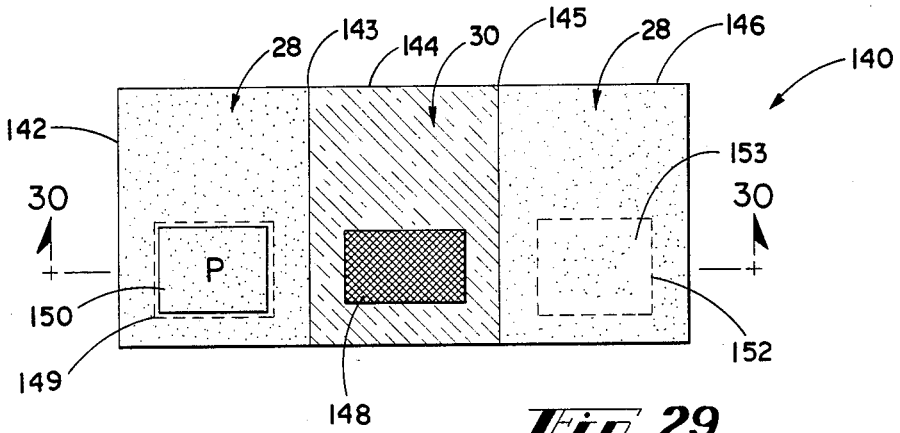
Fig_29
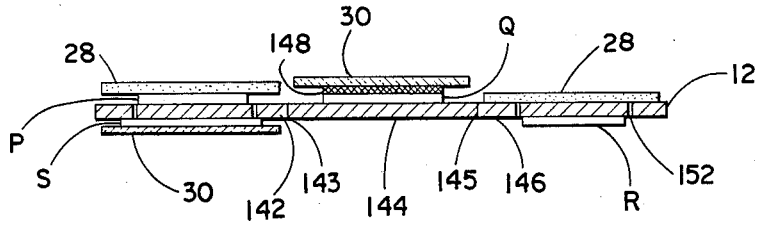
Fig_30
Fig_31
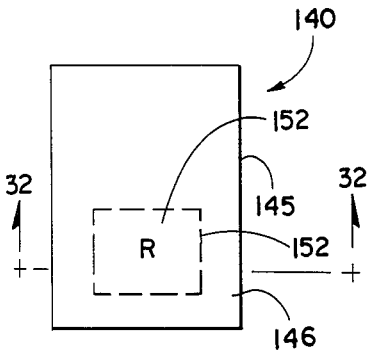
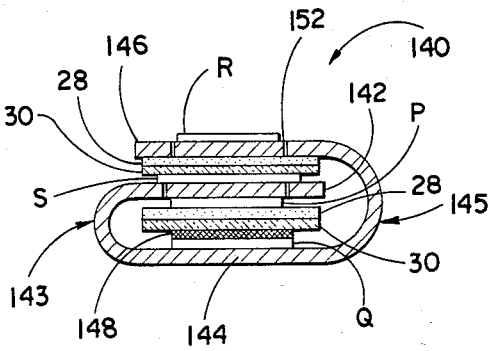
Fig_32

PROMOTIONAL ARTICLE WITH PRESSURE-SENSITIVE ADHESIVE PORTIONS AND METHOD OF MANUFACTURE

TECHNICAL FIELD

The present invention relates to a promotional article bearing promotional indicia, and more particularly relates to such an article including portions removable by means of perforations and pressure-sensitive adhesive, made from a single sheet of material and optionally including indicia hidden by a removable opaque mask.

BACKGROUND ART

In the past, promotional articles have been produced including detachable coupons, labels and the like, or having cover sheets or masks that can be removed to reveal a hidden message. For example, U.S. Pat. No. 4,307,900 shows a coupon vehicle on which indicia have been printed and covered with a layer of pressure-sensitive adhesive. A release strip is laminated over the adhesive and sectionally removed to attach a package portion, such as a proof of purchase seal, in place over the indicia.

U.S. Pat. No. 3,822,901 shows a hidden message apparatus having a sheet bearing on one side indicia covered by opaque means such as removable tape, and bearing on the other side adhesive protected by a release sheet. The main sheet is perforated to permit portions bearing the indicia to be removed and attached to some other article.

U.S. Pat. No. 4,033,611 shows a multi-ply lottery ticket folded into multiple layers permanently secured to one another and perforated to permit flaps to be lifted to reveal indicia beneath the flaps.

In another prior device, a two-ply game assembly is glued to the release sheet of a conventional bumper sticker. The game card had a play area that could be torn away from an area of the game card glued to the release sheet. The play portion consisted of an adhesive-coated layer and a release sheet having "scratch-off" areas for playing the game.

U.S. Pats. Nos. 2,321,184; 2,274,488; 3,582,111; 3,711,683; 4,004,058; and 4,059,912 show other articles having removable stickers or hidden messages or the like. U.S. Pats. Nos. 4,095,824 and 4,241,942 show secure contest cards utilizing an opaque removable mask over printed indicia.

It will be seen from an examination of these examples of the prior art that when a pressure-sensitive adhesive has been used in connection with a promotional article, a separate release sheet has been laminated against the pressure-sensitive adhesive, thus adding to the complexity and expense of the manufacturing process.

SUMMARY OF THE INVENTION

The present invention provides a promotional article and method of making same which take advantage of the convenience of pressure-sensitive adhesive without the necessity of laminating a separate release sheet to the sheet upon which the pressure-sensitive adhesive is applied. In the various embodiments described herein, the concept of the invention is utilized to provide tear-away labels, coupons, stickers and the like, the removal of which can reveal hidden information. The tear-away portions can also have "scratch-off" masks applied to conceal hidden information.

Articles embodying the invention are made by processing a continuous web of sheet material by printing indicia thereon, applying a release coat to an appropriate panel, applying pressure-sensitive adhesive to another panel, perforating one of the panels to form removable portions thereof, folding the web to engage the release coat with the pressure-sensitive adhesive, and separating the web into individual promotional articles.

Generally described, the present invention provides a promotional article comprising a single sheet including a first panel and a second panel separated by a fold line, one of the panels bearing an area of pressure-sensitive adhesive and one of the panels being perforated to permit removal of a removable portion of the panel, the one of the panels not bearing the adhesive bearing an area of release coat positioned to receive the area of adhesive, the panels being folded together to engage the adhesive with the release coat, and the removable portion bearing adhesive or release coat of the panel from which it is removable. In one embodiment, the first panel bears the adhesive and defines the removable portion, and the second panel bears a transparent release coat and includes first indicia printed thereon beneath the release coat, the first indicia being positioned to be exposed upon removal of the removable portion. In an alternative embodiment, the first panel bears the release coat and defines the removable portion, while the first indicia is printed beneath the adhesive.

In a further embodiment, second indicia are printed on the exposed surface of the removable portion, and a removable opaque mask is applied overlying the second indicia.

Generally described, the present invention also provides a method of making a promotional article, comprising the steps of applying a strip of release coat to a first area of a continuous web of sheet material, applying a strip of pressure-sensitive adhesive to a second area of the web, perforating successive removable portions of the material along one of the first and second areas, folding the material to engage the first and second areas, and separating the material transversely across the web to form individual articles. The method can be used to manufacture promotional articles having several different configurations, as disclosed in detail below.

The invention also provides a promotional puzzle article comprising a single sheet including a first panel and a second panel separated by a fold line, one of the panels bearing an area of pressure-sensitive adhesive, one of the panels being perforated to permit removal of a first removable portion and a plurality of second removable portions of the panel, the one of the panels not bearing the adhesive bearing an area of release coat positioned to receive the area of adhesive, the panels being folded together to engage the adhesive with the release coat, the removable portions bearing adhesive or release coat of the panel from which they are removable; and the second removable portions being shaped to be received adjacent to one another within the exposed area left after removal of the first removable portion.

The invention also provides a promotional article comprising a single sheet having a top surface and a bottom surface; the sheet defining a first panel, a second panel separated from the first panel by a first fold line, and a third panel separated from the second panel by a second fold line; pressure-sensitive adhesive coating the top surface of the first and third panels; release coat coating the top surface of the second panel beneath the release coat; and second indicia printed on the bottom surface of the first panel beneath the release coat; the first panel being folded onto the top surface of the second panel, and the third panel being folded onto the bottom surface of the first panel.

Thus, it is an object of the present invention to provide an improved promotional article and method of making same.

It is a further object of the invention to provide a promotional article utilizing pressure-sensitive adhesive without a separate release sheet.

It is a further object of the invention to provide a promotional article including tear-away labels, stickers, coupons, or the like.

It is a further object of the invention to provide a promotional article including tear-away portions concealing hidden information.

It is a further object of the invention to provide a promotional article including tear-away portions and utilizing "scratch-off" or other removable opaque masking to conceal hidden information.

It is a further object of the invention to provide a method for making a promotional article including pressure-sensitive adhesive, a release coat, and tear-away portions, from a single sheet of material.

Other objects, features, and advantages of the invention will become apparent upon review of the following detailed description of embodiments of the invention, when taken in conjunction with the drawing.

BRIEF DESCRIPTION OF THE DRAWING

FIG. 1 is a plan view of a promotional article embodying the invention, prior to folding.

FIG. 2 is a cross sectional view of the article of FIG. 1, taken along line 2—2 of FIG. 1.

FIG. 3 is a plan view of the article of FIG. 1 after folding.

FIG. 4 is a cross sectional view taken along line 4—4 of FIG. 3.

FIG. 5 is a cross sectional view taken along line 5—5 of FIG. 3.

FIG. 7 is a plan view of a second embodiment of a promotional article according to the invention, prior to folding.

FIG. 8 is a cross sectional view taken along line 8—8 of FIG. 7.

FIG. 9 is a plan view of a third embodiment of a promotional article according to the invention, prior to folding.

FIG. 10 is a cross sectional view taken along line 10—10 of FIG. 9.

FIG. 11 is a plan view of a fourth embodiment of a promotional article according to the invention, prior to folding.

FIG. 12 is a cross sectional view taken along line 12—12 of FIG. 11.

FIG. 13 is a plan view of the article of FIG. 11 after folding.

FIG. 14 is a cross sectional view taken along line 14—14 of FIG. 13.

FIG. 15 is a plan view of a fifth embodiment of a promotional article according to the invention, prior to folding.

FIG. 16 is a cross sectional view taken along line 16—16 of FIG. 15.

FIG. 17 is a plan view of the article of FIG. 15 after folding.

FIG. 18 is a cross sectional view taken along line 18—18 of FIG. 17.

FIG. 19 is is a bottom view of a sixth embodiment of a promotional article according to the invention, prior to folding.

FIG. 20 is a cross sectional view taken along line 20—20 of FIG. 19.

FIG. 21 is a plan view of the article of FIG. 19 after folding.

FIG. 22 is a cross sectional view taken along line 22—22 of FIG. 21.

FIG. 23 is a plan view of the article of FIG. 21, showing the removal of the assembly of adhered panels.

FIG. 24 is a plan view of a seventh embodiment of a promotional article according to the invention, prior to folding.

FIG. 25 is a cross sectional view taken along line 25—25 of FIG. 24.

FIG. 26 is plan view of the puzzle article of FIG. 24 after folding.

FIG. 27 is a cross sectional view taken along line 27—27 of FIG. 26.

FIG. 28 is a plan view of the puzzle article of FIG. 26, showing the removable pieces readhered to the puzzle assembly area.

FIG. 29 is a plan view of an eighth embodiment of a promotional article according to the invention, prior to folding.

FIG. 30 is a cross sectional view taken along line 30—30 of FIG. 29.

FIG. 31 is a plan view of the article of FIG. 29 after folding.

FIG. 32 is a cross sectional view taken along line 32—32 of FIG. 31.

DETAILED DESCRIPTION

Figure 6A:
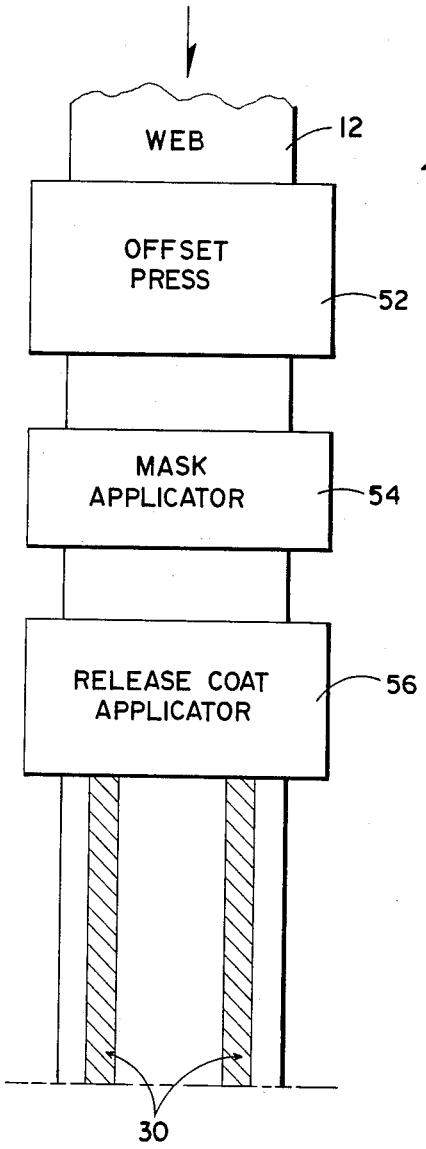
FIG. 6A is a diagrammatic representation of a press line for performing the initial operations in the process of making the article shown in FIG. 1.

Referring now to the drawing, in which like numerals refer to like parts throughout the several views, FIGS. 1-5 show a promotional article 10 embodying the present invention. FIG. 1 shows a top plan view of a sheet 12 of foldable material, such as paper or the like. The sheet 12 can be any foldable material capable of being printed and coated with the substances described below. The sheet 12 has a top surface 13 and a bottom surface 14, and is divided into a cover panel 16, a hidden panel 18 foldably connected to the cover panel 16 along a fold line 34, and a display panel 20 connected to the hidden panel 18 along a line of perforation 36. The perforation 36 permits the display panel 20 to be separated from the remainder of the sheet 12 by tearing.

The cover panel 16 includes at least one connected line of perforation 25 enclosing a removable portion 26, which can be torn away from the remainder of the panel 16. In the embodiment shown, three square removable portions 26 are provided. The cover panel 16 also is coated on the top surface 13 with a pressure-sensitive adhesive 28 of a type well known in the art and commonly used on bumper stickers and the like. The pressure-sensitive adhesive 28 is shown by stippling in the drawing, and is preferably applied to the entire surface of the panel 16 including the area within the perforations 25.

The top surface 13 of the hidden panel 18 is printed with indicia A, B, C opposite the removable portions 26. Similarly, the top surface of the display panel 20 is printed with promotional information P. The cover panel 16 is printed with indicia D, E, F on the lower surface thereof within the outlines of the removable portions 26, as shown in FIGS. 2 and 3.

The entire hidden panel 18 is coated with a release coat 30, which is transparent and is indicated by light diagonal hatching in the drawing. The release coat 30 comprises a well known substance which adheres to the pressure-sensitive adhesive when pressed against the adhesive, but can be pulled apart without detriment to the bonding ability of the adhesive. The indicia A, B, C are covered by the release coat 30 but are visible through the release coat.

The sheet 12 with the various coatings described above is shown in FIG. 2. It should be noted that FIG. 2 is a diagrammatic cross sectional view in which thicknesses have been greatly expanded to aid in describing the structure of the promotional article 10, and that the finished materials are very much thinner than represented in the drawing.

To assemble the promotional article 10 from the flat form shown in FIGS. 1 and 2 to the finished form shown in FIGS. 3–5, the cover panel 16 is folded about the fold line 34 onto the hidden panel 18. The pressure-sensitive adhesive 28 engages and adheres to the release coat 30 with the removable portion 26 aligned over the indicia A, B, C. The edge of the cover panel 16 lies closely adjacent to the perforation 36, so that the display panel 20 can be separated, if desired, from the two-ply assembly now formed by the cover and hidden panels.

It will now be seen that the indicia A, B, C function as hidden indicia obscured from view by the cover panel 16. The purpose of the promotional article 10 may be, for example, to award a premium or prize to the holder. In such case, the hidden indicia A, B, C, alone or in a predetermined combination, inform the holder whether a premium has been won. The holder determines whether he or she has a winning article by removing the removable portions 26 by tearing along the perforations 25. As shown in FIG. 5, when the removable, portion 26 bearing the indicia E is removed, it carries with it the underlying section of pressure-sensitive adhesive 28 and exposes the hidden indicia B seen through the release coat 30. The removable portion 26 now also forms a label or sticker bearing the indicia E, and can be attached to another vehicle such as a product package or a promotional sheet having spaces for collection of such labels.

If it is desired to form a removable label which does not have an adhesive backing, the promotional article 10 can be made with a transparent pressure-sensitive adhesive applied to the hidden panel 18 over the indicia A, B, C, and with a release coat applied to the cover panel 16. The only difference in function of the article will be the non-adhesive removable portions and an adhesive layer over the hidden indicia. Some other label or the like could be adhered to the adhesive within the perforations 25 after the removable portions are removed. Furthermore, the removable portions have a release coat backing and could be adhered to another surface coated with a pressure-sensitive adhesive.

Figure 6B:
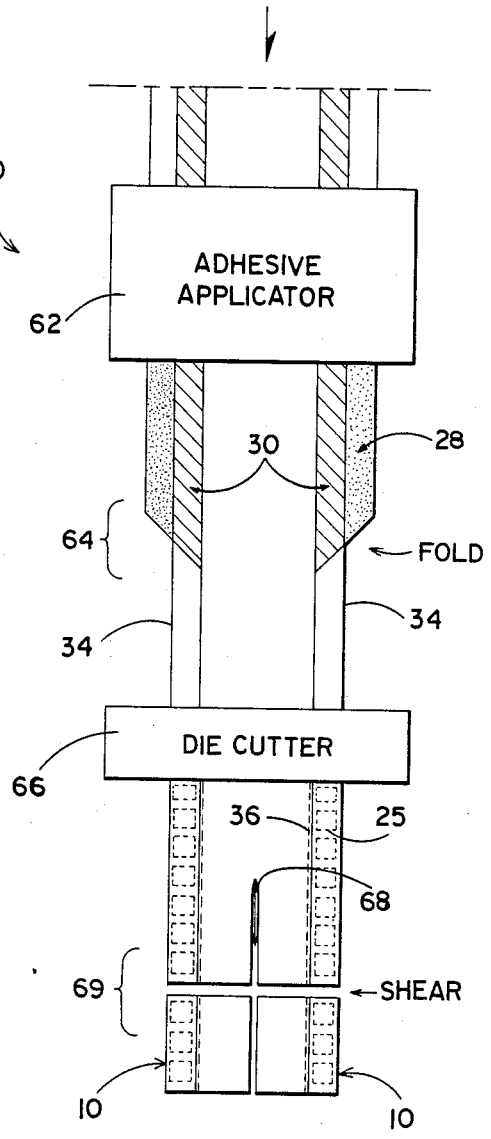
FIG. 6B is a diagrammatic representation of a finishing line for performing the final operations in the process of making the article shown in FIG. 1.

Now that the features of the promotional article 10 have been described, the particular method for forming the article 10 will be described with reference to FIG. 6. The sheet 12 is part of a continuous web of such material, which is run through a press line 50, shown in FIG. 6A, and then through a finishing line 60, shown in FIG. 6B. The press and finishing lines may be separate operations, or may be a continuous process, as indicated by the match lines in FIG. 6.

Initially, the web of sheet material 12 passes through a conventional offset press 52, where the printed indicia A, B, C, D, E, F and P are printed onto the surfaces of the web. Then the web is passed through a mask applicator 54 where an opaque mask can be placed over some of the indicia if desired. Use of such masks in connection with the present invention is described in more detail below. The next step is to pass the web through a release coat applicator 56 which applies a continuous strip or strips of release coat 30 to the web. In the apparatus diagrammatically shown, two articles 10 are simultaneously made, and therefore two sets of indicia, masks, and strips of release coat are applied. For practical installations, it is normally necessary to apply the release coat and any mask to the same surface of the web.

Following the application of the release coat 30, the web is transferred to the finishing line 60, where it is passed through an adhesive applicator 62. A strip of pressure-sensitive adhesive 28 is applied adjacent to each strip of release coat 30 and adjacent to the edges of the web. Next, the web passes through a folding station 64 where the strips bearing the adhesive 28 are folded in a conventional manner onto the strips bearing the release coat 30. Then the folded web passes through a die cutter 66 where the perforations 25 and 36 are made. Those skilled in the art will understand that the die cutter can be configured to punch only through the top layer of material, that is, the cover panel, when forming the perforations 25. Downstream of the die cutter 66, the web traverses a slitter 68 which divides the web into a pair of mirror image webs. Finally, a shear 69 cuts off pairs of promotional articles 10 with each cut. The various components can be set to continuously produce promotional articles 10 identical to those shown in FIGS. 1–5.

The use of an opaque mask to cover indicia in connection with the type of promotional article shown in FIGS. 1–5 is shown in connection with a second embodiment 70 of the invention shown in FIGS. 7 and 8. The elements of the promotional article 70 are identical to those of the article 10 with the exception of the addition of areas of opaque mask 72 applied over the indicia D, E, and F. The mask areas 72 are shown as separate cross hatched circles, but could be any shape. Alternately, the entire panel 18 could bear a layer of mask material. As best shown in FIG. 8, the mask is applied over the indicia and under the release coat 30. Thus, in FIG. 6A, the mask applicator 54 is positioned following the offset press 52 but prior to the release coat applicator 56.

The material forming the mask 72 is preferably a removable elastomeric material of the type decribed in U.S. Pats. Nos. 4,095,824 and 4,241,942, which are expressly incorporated herein by reference in their entireties. However, any type of covering material which will provide a suitable visual mask is contemplated by the present invention. When used for secure "scratch-off" games and the like, the mask material should be removable in sections so that it cannot be repositioned after observation of the underlying indicia. A security pattern could also be printed on the sheet 12 to prevent premature determination of the nature of the indicia under the masks, as described in the patents incorporated above.

The indicia A, B, C can be revealed by a user of the promotional article 70 first by removing the removable portions 26 and then by scratching off both the release coat 30 and the mask 72 using a coin or the like, in a manner well known in the art.

A third embodiment of the invention is shown in FIGS. 9 and 10 which depict a promotional article 75. The article 75 is very similar to the article 10 shown in FIGS. 1–5. However, a series of masks 77 have been applied by the mask applicator 54 along the hidden panel 18. The pressure-sensitive adhesive 28 is applied to the hidden panel 18 with a series of uncoated areas or gaps 76 left by the adhesive applicator 62 around the masks 77. The release coat 30 is applied to the cover panel 16. Thus, it will be seen that the masks 77 can be scratched off the indicia A, B, C without the need to remove the adhesive 28. The same concept can be applied to the promotional article 70 of FIG. 7 by providing similar gaps in the release coat 30.

It should now be understood that opaque masks of the type described can be applied as desired to any of the panels of the first embodiment shown in FIGS. 1–5.

A fourth embodiment of the invention is shown in FIGS. 11–14, which depict a promotional article 40. The article 40 is very similar to the article 10, but has added thereto a second display panel 42, which is foldably connected to the panel 20 along a fold line 43. Additional promotional indicia Q and R are printed on the top and bottom surfaces, respectively, of the panel 42. In the assembled form shown in FIG. 13, the bottom side of the panel 42 faces upwardly, so that the user sees the promotional indicia R and the panel 42 acts as a cover that is not secured to the other panels. In use, the panel 42 is lifted, exposing the indicia P and Q, and also the indicia D, E, F on the removable portions 26. If desired, opaque masks such as described above can be applied to any of the panels.

A fifth embodiment of the invention is shown in FIGS. 15–18, which depict a promotional article 80. In the article 80, the sheet 12 is divided such that the cover panel 16 and hidden panel 18 lie along opposite side edges 88 and 89 of the sheet. As shown, the hidden panel 18 is printed with the indicia A, B, C and coated with pressure-sensitive adhesive 28 while the cover panel 16 is die cut to form the removable portions 26 and coated with release coat 30. Of course, the pressure-sensitive adhesive and release coat could be reversed. A first display panel 82 is connected to the hidden panel 18 along a line of perforation 83. A second display panel 84 is foldably connected to the first display panel 82 along a fold line 85. Promotional indicia P are printed on the bottom surface of the panel 84, and indicia Q are printed on the top surface of the panel 82. If desired, indicia can also be printed on the remaining surfaces of the panels 82 and 84. The cover panel 16 is connected to the panel 84 along a line of perforation 86.

Assembly of the promotional article 80 is done by folding the panels 16 and 84 about fold line 85 onto panels 18 and 82. This engages the release coat 30 on the panel 16 with the pressure-sensitive adhesive 18 on the panel 18, holding the assembly together as shown in FIG. 18, until the adhesive and release coat are separated as a unit by tearing along lines 83 and 86. Use with regard to the removable portions 16 and hidden indicia is similar to use of the article 10 shown in FIG. 1.

It should be understood that all variations relating to coatings, indicia, and masks discussed above in connection with other embodiments can be utilized in the article 80.

A sixth embodiment of the invention is shown in FIGS. 19–23, which depict a promotional article 90. FIG. 19 shows the bottom surface 14 of the sheet 12, which is printed, coated and perforated to form the article 90. The cover panel 16 and hidden panel 18 are again formed along opposite edges of the the sheet 12. The top surface 13 of the cover panel 16 is coated with pressure-sensitive adhesive 28, as shown in FIG. 20. The bottom surface 14 of the cover panel 16 is printed with indicia D, E, F, which are then covered by a layer of opaque mask material 93. The panel 16 is perforated to form the removable portions 26, with the perforations 25 surrounding the masks 93.

A display panel 91 is connected to the panel 16 along a perforation 94, and has indicia P printed on the bottom surface thereof. A rear panel 92 is foldably connected to the display panel 91 along a fold line 95. The rear panel 92 is equal in width to the combined panels 16 and 91. The hidden panel 18 is connected to the panel 92 along a perforation 96, and is coated on its bottom surface with release coat 30.

The promotional article 90 is assembled to a form shown in FIGS. 21 and 22 by folding the hidden panel 18 along line 96 against the top surface of the rear panel 92. Then the cover panel 16 and display panel 91 are together folded about line 95 to engage the pressure-sensitive adhesive 28 with the release coat 30, as best shown in FIG. 22. In assembled form, the masks 93 on the removable portions 26 face upwardly. As shown in dotted lines in FIG. 21, the masks 93 can be removed by rubbing them away with a coin to expose the indicia D, E, F.

As was the case for previous embodiments, the assembled cover and hidden panels 16 and 18 can be torn away as a unit from the remainder of the promotional article 90. FIG. 23 shows such panels partially torn away along perforations 94 and 96. It should be noted that when manufacturing the article 90 with an apparatus of the type shown in FIG. 6, it would be necessary to provide a die cutter or other perforation device to cut the line of perforation 96 prior to folding the panel 18. Since the adhesive 28 is applied to the opposite surface of the sheet 12 from the release coat 30, the web could be reversed following the press line before running through the finishing line for adhesive application, folding and perforation.

A seventh embodiment of the invention is shown in FIGS. 24–28, which depict a promotional puzzle article 100. The article 100 is prepared by dividing the sheet 12 into a cover panel 116 and a hidden panel 118, which are foldably connected along a fold line 135. The cover panel 116 includes a plurality of connected perforations 125, preferably irregular in shape. The perforations 125 enclose removable portions 126 which are designed to fit together as a puzzle. Another connected perforation 128 is cut into the cover panel 116, surrounding a relatively large removable portion 129. The removable portion 129 is preferably regular in shape, such as the rectangle shown, and is designed so that the removable portions 126, when fitted together as a completed puzzle, fit within the area defined by the perforation 128.

The cover panel 116 is printed on its bottom surface with indicia 1, 2, 3, 4 within the perforations 125. These indicia match together to form a single meaningful design when the removable portions 126 are fitted together. Another set of indicia 5 are printed within the the perforation 128 and can be promotional in nature or communicate some other message, such as instructions for playing the puzzle. The top surface of the cover panel 116 is coated with pressure-sensitive adhesive 28.

The hidden panel 118 is printed on its top surface with indicia A, B, C, D positioned so as to lie within the outline of the perforations 125 when the article 100 is assembled. Another set of indicia E are printed in alignment with the perforation 128. The indicia E preferably includes information or a design to assist in placement of the removable portions 126 after removal of the removable portion 129, although the shape of the removable portions 126 may be relied upon as the sole guide for placement, as in a conventional jigsaw puzzle. After printing, the hidden panel is coated with a layer of transparent release coat 30.

The puzzle article 100 is assembled by folding along the fold line 135 to engage the pressure-sensitive adhesive 28 on the cover panel 116 with the release coat 30 on the hidden panel 118. Unlike previous embodiments, preferably no areas of the article 100 are not adhered to another panel. The indicia and perforations align as noted above and as shown in FIG. 27.

In order to use the article 100, the user tears away the removable portion 129, as shown in FIG. 27, leaving a depression 130 which provides a puzzle assembly area coated with release coat 30 through which the indicia E are visible. Then the removable portions 126 are removed. The removable portions 126 retain their adhesive backing and can be placed within the depression 130 defined by the perforation 128. The indicia 1, 2, 3, 4 can be used to assemble the puzzle, along with the interlocking shapes and any guiding information contained in the indicia E. The pieces of the puzzle provided by the removable portio s 126 can be moved around the puzzle assembly area as needed because of the capability of the pressure-sensitive adhesive and release coat to be repeatedly separated and reengaged. FIG. 28 shows the completed puzzle, with the indicia A, B, C, D revealed and the removable portions 126 properly matched within the perforation 128 and adhered to the release coat on the hidden panel 118.

Of course, many variations in the puzzle components are possible. The matching of the puzzle pieces can be provided by either interlocking shapes, indicia on the pieces, or guiding indicia within the puzzle assembly area, or any combination of these methods. Opaque masks can be added as described above to either the cover panel 116, the hidden panel 118, or both. As with other embodiments of the invention, the application of the pressure-sensitive adhesive and the release coat could be reversed to the opposite panel. The puzzle article 110 can be used promotionally in a variety of ways, such as to reward a consumer upon successful completion of the puzzle.

An eighth embodiment of the invention is shown in FIGS. 29–32, which depict a promotional article 140. In the article 140, the sheet 12 is divided into a first hidden panel 142, a second hidden panel 144 separated from the panel 142 by a fold line 143, and a cover panel 146 separated from the panel 144 by a fold line 145.

The first hidden panel is printed on its top surface (shown in FIG. 29) with a security pattern P, and coated with pressure-sensitive adhesive 28 over the security pattern. The bottom surface of the panel 142 is printed with promotional indicia S and coated with release coat 30, as shown in FIG. 30. The release coat on the panel 142 is preferably a web offset release coat. The panel 142 is perforated at 149 to form a removable portion 150 surrounding the security pattern P.

The second hidden panel 133 is printed on its top surface with an indicia Q, which is covered by a removable mask 148. The indicia Q is positioned to be covered also by the security pattern P when the article is folded. Release coat 30, preferably a gravure release coat, is applied to the panel 144 over the mask 148.

The cover panel 146 is coated on its top surface with pressure-sensitive adhesive 28, and is printed on its bottom surface with indicia R. The panel 146 is perforated at 152 to form a removable portion 153 positioned in mating relationship with the removable portion 150.

The promotional article 140 is assembled to a form shown in FIGS. 31 and 32 by first folding the first hidden panel 142 onto the second hidden panel 144 about fold line 143, engaging the adhesive on the panel 142 with the release coat on the panel 144. Then the cover panel 146 is folded about fold line 145 onto the bottom surface (now facing upwardly) of the first cover panel 142, engaging the adhesive on the panel 146 with the release coat on the panel 142. In this configuration, the indicia R, surrounded by the perforation 152, faces upwardly in the finished article 140 as shown in FIGS. 31 and 32. The perforations 152 and 149 are vertically aligned with each other and with the indicia S, the security pattern P, the mask 148, and the indicia Q.

In use, the removable portion 153 can be torn away to expose the indicia S. Then, the removable portion 150 can be torn away to expose the mask 148, which can be scraped off to expose the innermost indicia Q. Alternately, the perforations can be omitted and the indicia exposed by separating the panel 146 from the panel 142, and then the panel 142 from the panel 144. The mask or the security pattern, or both, could also be omitted.

It will be understood by those skilled in the art that the article 140 can be produced using an apparatus of the type shown in FIG. 6, modified so that the perforations in the panels 142 and 153 would be made prior to folding if it is desired not to perforate the panel 144.

A number of embodiments of the invention have been described, as well as a method and apparatus for continuously making promotional articles embodying the invention. After understanding the method of the invention for making an embodiment as shown in FIG. 6, those skilled in the art will readily be able to apply the concepts of the invention to modify such an apparatus as shown in FIG. 6 to make the other embodiments described herein. Furthermore, the release coat 30 can be either a web offset release coat or a gravure release coat.

Those skilled in the art will also understand that the application of indicia, perforations, pressure-sensitive adhesive, release coat and masks can be selectively positioned for all of the embodiments described. The particular placement shown by example in the drawing is not intended to limit the concepts of the present invention. For example, the pressure-sensitive adhesive or release coat could be applied only to portions of panels or removable portions. Furthermore, the release coat 30 can be either a web offset release coat or a gravure release coat.

While this invention has been described in detail with particular reference to preferred embodiments thereof, it will be understood that variations and modifications can be made without departing from the spirit and scope of the invention as defined in the appended claims.

We claim:

1. A promotional article comprising:

a single sheet including a first panel and a second panel separated by a fold line;

said first panel bearing an area of pressure-sensitive adhesive and being perforated to permit removal of a removable portion thereof, said removable portion including at least a part of said area bearing said adhesive;

said second panel bearing an area of transparent release coat positioned to receive said area of adhesive and including first indicia printed thereon beneath said release coat, said first indicia being positioned to be exposed upon removal of said removable portion;

said first and second panels being folded together to engage said adhesive with said release coat; and a third panel foldably connected to said second panel and foldable to cover said first panel.

2. The article of claim 1, wherein said pressure-sensitive adhesive covers said entire first panel; and said release coat covers said entire second panel.

3. A promotional article comprising:

a single sheet including a first panel and a second panel separated by a fold line;

said first panel bearing an area of release coat and being perforated to permit removal of a removable portion thereof, said removable portion including at least a part of said area bearing said release coat;

said second panel bearing an area of transparent adhesive positioned to receive said area of release coat and including first indicia printed thereon beneath said adhesive, said first indicia being positioned to be exposed upon removal of said removable portion;

said first and second panels being folded together to engage said adhesive with said release coat; and a third panel foldably connected to said first panel and foldable to cover said second panel.

4. A promotional article comprising:

a single sheet including a top surface and a bottom surface, and a pair of parallel side edges, and defining a first panel and a second panel separated by a first fold line parallel to said side edges;

said first panel bearing an area of pressure-sensitive adhesive comprising a strip bearing said adhesive lying adjacent to one of said side edges on the top surface of said first panel;

said second panel bearing an area of release coat positioned to receive said area of adhesive, said area of release coat comprising a strip bearing said release coat lying adjacent to the other side edge on the bottom surface of said second panel and separated from the remainder of said second panel by a second fold line parallel to said first fold line;

said first panel being perforated to permit removal of a removable portion thereof, said removable portion of said first panel including at least a part of said area bearing said adhesive; and said strip of said second panel bearing said release coat being folded about said second fold line against the top surface of said sheet and said first panel being folded about said first fold line to engage said strip of adhesive with said strip of release coat.

5. The article of claim 4, further comprising perforated tear lines along said second fold line and separating said strip of said first panel bearing said adhesive from the remainder of said first panel, such that said two strips can be separated from the remainder of said sheet.

6. A promotional article comprising:

a single sheet including a top surface and a bottom surface, and a pair of parallel side edges, and defining a first panel and a second panel separated by a first fold line parallel to said side edges;

said first panel bearing an area of pressure-sensitive adhesive comprising a strip bearing said adhesive lying adjacent to one of said side edges on the top surface of said first panel;

said second panel bearing an area of release coat positioned to receive said area of adhesive, said area of release coat comprising a strip bearing said release coat lying adjacent to the other side edge on the bottom surface of said second panel and separated from the remainder of said second panel by a second fold line parallel to said first fold line;

said first panel being perforated to permit removal of a removable portion thereof, said removable portion of said first panel including at least a part of said area bearing said adhesive; and the bottom surface of said removable portion including indicia printed thereon and a removable opaque mask overlying said indicia;

said strip of said second panel bearing said release coat being folded about said second fold line against the top surface of said sheet and said first panel being folded about said first fold line to engage said strip of adhesive with said strip of release coat; and said sheet defining perforated tear lines along said second fold line and separating said strip of said first panel bearing said adhesive from the remainder of said first panel, such that said two strips can be separated from the remainder of said sheet.

7. A promotional article comprising:

a single sheet including a first panel and a second panel separated by a fold line;

said first panel bearing an area of pressure-sensitive adhesive;

said second panel bearing an area of release coat positioned to receive said area of adhesive;

one of said first and second panels being perforated to permit removal of a removable portion of said perforated panel, said removable portion of said perforated panel including at least a part of said area bearing said adhesive or release coat;

said one panel defining said removable portion including first indicia printed on the surface of said removable portion not bearing said adhesive or release coat, and a removable opaque mask overlying said first indicia;

the release coat or adhesive on said other panel being transparent and said other panel further including second indicia printed thereon beneath said release coat or adhesive; and said panels being folded together to engage said adhesive with said release coat such that said second indicia is exposed upon removal of said removable portion.

8. The article of claim 7, wherein said adhesive and release coat cover less than the entire areas of said first and second panels, and further comprising mating perforated tear lines in said first and second panels such that the areas of said panels bearing said adhesive and release coat can be separated from the remainder of said panels.

9. The article of claim 7, wherein said first panel bears a transparent adhesive and includes said second indicia printed thereon beneath said adhesive; and wherein said second panel bears a transparent release coat and defines said removable portion; said second indicia being positioned to be exposed upon removal of said removable portion.

10. The article of claim 9, wherein said second panel includes said first indicia printed on the surface of said removable portion not bearing said release coat.

11. A promotional puzzle article comprising:

a single sheet including a first panel and a second panel separated by a fold line;

one of said panels bearing an area of pressure-sensitive adhesive;

one of said panels being perforated to permit removal of a first removable portion and a plurality of second removable portions of said panel;

the one of said panels not bearing said adhesive bearing an area of release coat positioned to receive said area of adhesive;

said panels being folded together to engage said adhesive with said release coat;

said removable portions bearing adhesive or release coat of the panel from which they are removable; and said second removable portions being shaped to be received adjacent to one another within the exposed area left after removal of said first removable portion.

12. The article of claim 11, wherein said second removable portions are shaped to have interlocking edges.

13. The article of claim 11, wherein said second removable portions bear mating indicia that can be aligned in a preferred orientation when said second removable portions are placed within the exposed area left upon removal of said first removable portion.

14. The article of claim 11, wherein said exposed area left upon removal of said first removable portion bears transparent adhesive or release coat and alignment indicia beneath said adhesive or release coat, such that said second removable portions can be placed in accordance with said alignment indicia.

15. The article of claim 11, wherein said second removable portions bear indicia on the surface thereof not bearing adhesive or release coat, and a removable opaque mask overlying said indicia.

16. A promotional article comprising:

a single sheet having a top surface and a bottom surface; said sheet defining a first panel, a second panel separated from said first panel by a first fold line, and a third panel separated from said second panel by a second fold line;

pressure-sensitive adhesive coating the top surface of said first and third panels;

release coat coating the top surface of said second panel and the bottom surface of said first panel;

first indicia printed on the top surface of said second panel beneath said release coat; and second indicia printed on the bottom surface of said first panel beneath said release coat;

said first panel being folded onto the top surface of sad second panel, and said third panel being folded onto the bottom surface of said first panel.

17. The article of claim 16, further comprising a removable opaque mask overlying said first indicia beneath said release coat.

18. The article of claim 17, further comprising a security pattern printed on the top surface of said first panel beneath said pressure-sensitive adhesive so as to cover said first indicia when said first panel is folded onto said second panel.

19. The article of claim 16, wherein said first panel includes a line of perforation which surrounds said first indicia when said first panel is folded onto said second panel.

20. The article of claim 16, wherein said first panel includes a first line of perforation which surrounds said first indicia when said first panel is folded onto said second panel; third indicia printed on the bottom surface of said third panel; and a second line of perforation which surrounds said third indicia.

21. The article of claim 20, wherein said second line of perforation is matingly aligned with said first line of perforation when said third panel is folded onto the bottom surface of said first panel.

* * * * *